US008925143B2

(12) United States Patent
Brunnström et al.

(10) Patent No.: US 8,925,143 B2
(45) Date of Patent: Jan. 6, 2015

(54) FLUID SYSTEM FOR CLEANING MACHINE

(75) Inventors: Ludvig Brunnström, Åsa (SE); Patrik Andreasson, Barcelona (ES)

(73) Assignee: Qleeno AB, Gothenburg (SE)

( * ) Notice: Subject to any disclaimer, the term of this patent is extended or adjusted under 35 U.S.C. 154(b) by 0 days.

(21) Appl. No.: 14/129,965

(22) PCT Filed: Jun. 26, 2012

(86) PCT No.: PCT/SE2012/050715

§ 371 (c)(1),
(2), (4) Date: Dec. 28, 2013

(87) PCT Pub. No.: WO2013/002715

PCT Pub. Date: Jan. 3, 2013

(65) Prior Publication Data

US 2014/0143975 A1 May 29, 2014

(30) Foreign Application Priority Data

Jun. 28, 2011 (SE) ..... 1100500

(51) Int. Cl.

| | |
|---|---|
| ***A47L 7/00*** | (2006.01) |
| ***A47L 11/30*** | (2006.01) |
| ***A47L 11/293*** | (2006.01) |
| ***A47L 11/40*** | (2006.01) |

(52) U.S. Cl.

CPC ..... *A47L 11/302* (2013.01); *A47L 11/293* (2013.01); *A47L 11/305* (2013.01); *A47L 11/4038* (2013.01); *A47L 11/4044* (2013.01)

USPC ..... 15/322; 15/385

(58) Field of Classification Search

USPC ..... 15/320, 322, 385

IPC ..... A47L 7/00,11/30, 11/293

See application file for complete search history.

(56) References Cited

FOREIGN PATENT DOCUMENTS

| | | | |
|---|---|---|---|
| CA | 2585075 | A1 | 10/2007 |
| WO | 93/15646 | A1 | 8/1993 |
| WO | 98/27856 | A1 | 7/1998 |
| WO | 2007/129973 | A1 | 11/2007 |
| WO | 2011/102786 | A1 | 8/2011 |
| WO | 2011/162680 | A1 | 12/2011 |
| WO | 2013/002714 | A1 | 1/2013 |

OTHER PUBLICATIONS

Sweden Patent Office, Int'l Search Report in PCT/SE2012/050715, Sep. 7, 2012.

*Primary Examiner* — David Redding

(74) *Attorney, Agent, or Firm* — Piedmont Intellectual Property

(57) ABSTRACT

The invention relates to a fluid system (50) for cleaning machine (1), which comprises a floor treating brush and/or disc (7) rotatably driven by a motor (4) and exhibiting surrounding ring-shaped rim (8) and conduit for washing liquid and vacuum suction duct for the supply (11) of washing liquid (12) and suction (13) of washing liquid (14), respectively. A disc-shaped bottom part (25) provided with substantially radially extending vacuum suction ducts (24) is located above said rotatable brush and/or disc (7). A bottom cover (51) is connected to said bottom part (25), and nozzles (27) are connected to said vacuum ducts (24) along the periphery of said bottom part (25) and bottom cover (51) in order to suck up dirty washing liquid (14). Said bottom cover (51) and said bottom part (25) can be released from one another in order to reach said substantially radial vacuum suction ducts (24) located between them (25, 51).

10 Claims, 13 Drawing Sheets

FLUID SYSTEM FOR CLEANING MACHINE

The present invention relates to fluid system for cleaning machine, which comprises a floor treating brush and/or disc rotatably driven by a motor and exhibiting surrounding ring-shaped rim and conduit for washing liquid and vacuum suction duct for the supply of washing liquid and suction of washing liquid, respectively.

As regards cleaning machines for cleaning floors and other surfaces by means of a cleaning machine, which is preferably adapted and arranged to be driven or at least controlled manually by an operator walking and holding the handle of the machine, which protrudes backwards from said cleaning machine, clean washing liquid is supplied and dirty washing liquid is sucked up by means of separate systems and different conduits intended for that purpose. Problems arise when said conduits stop functioning, for example if they are clogged by certain objects or if they break, come loose, etc. Said conduits also entail that a lot of objects are placed on the exterior of the machine, which means that it becomes big and unwieldy and difficult to handle. It is also difficult to reach into narrow spaces and to handle the machine, for example when lifting and storing it. The replacement of parts is also made more difficult.

Therefore, the main object of the present invention is first of all to solve said problems by means of simple and safely functioning means in a from an economic point of view good way.

Said object is reached by means of a fluid system according to the present invention, which is mainly characterized in that a disc-shaped bottom part provided with substantially radially extending vacuum ducts is located above said rotatable brush and/or disc, that a bottom cover is connected to said bottom part, that nozzles are connected to said vacuum suction ducts along the periphery of said bottom part and bottom cover in order to suck up dirty washing liquid, whereby said bottom cover and said bottom part can be released from one another in order to reach said substantially radial vacuum ducts located between them.

Figure 1:
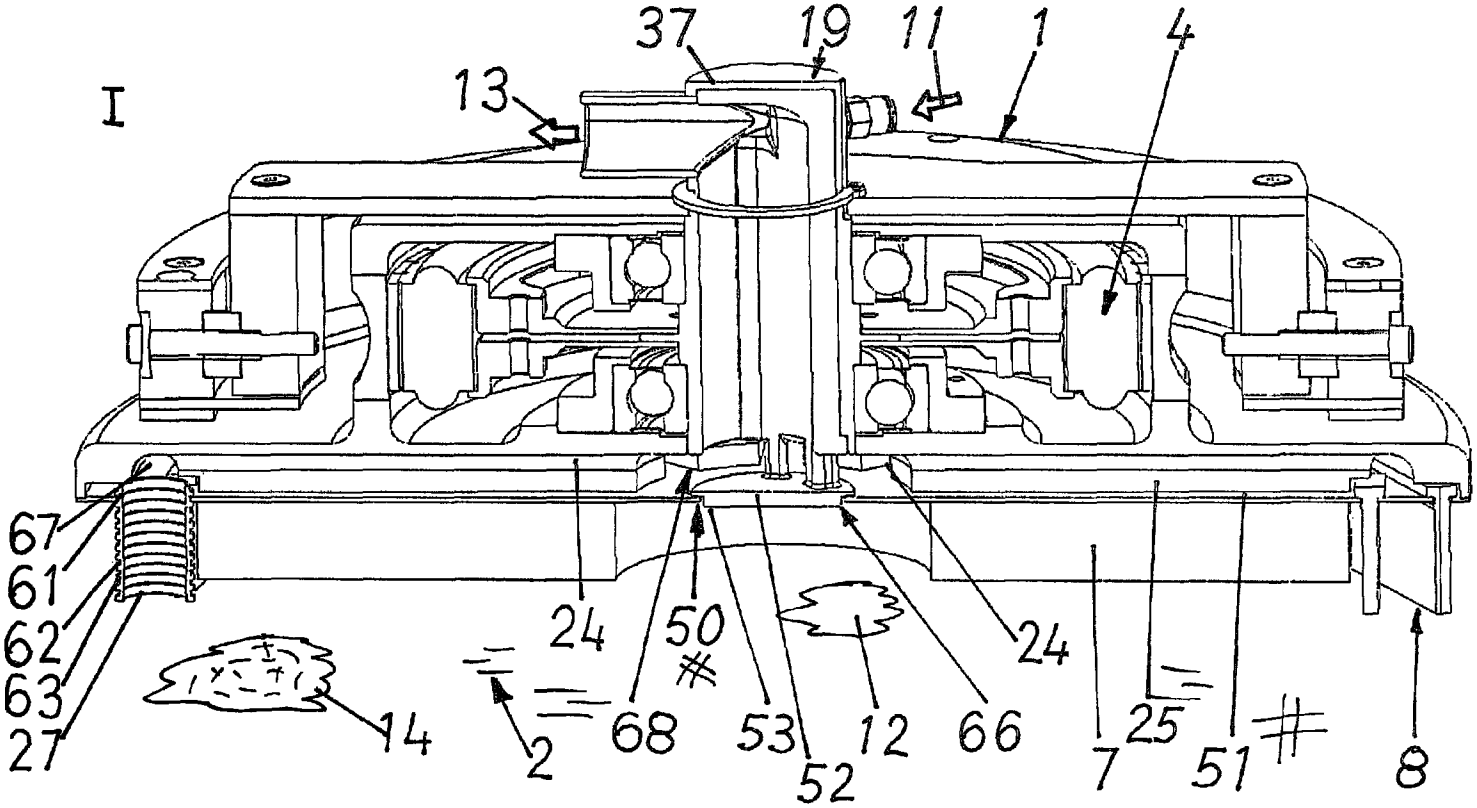
Figure 2:
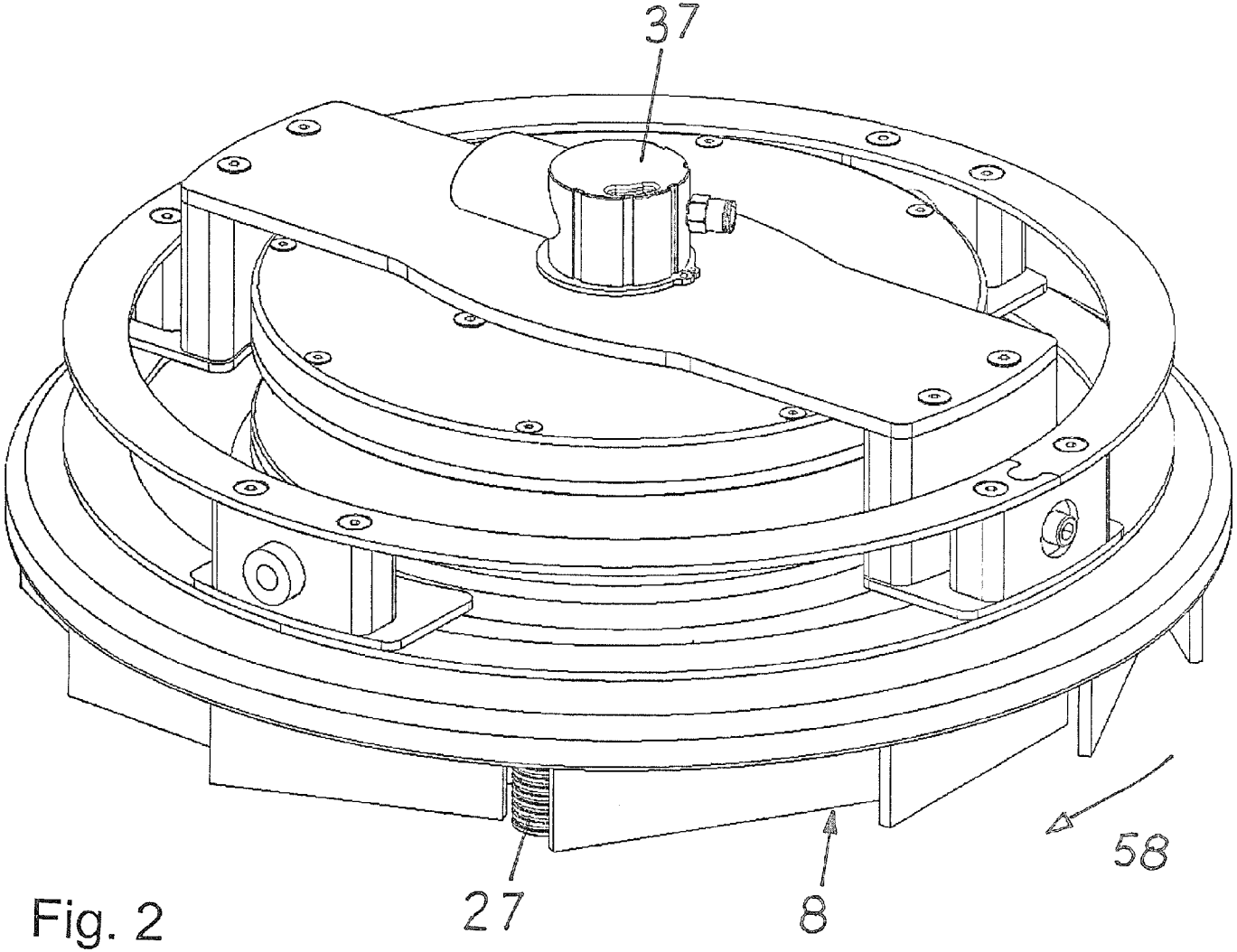
Figure 3:
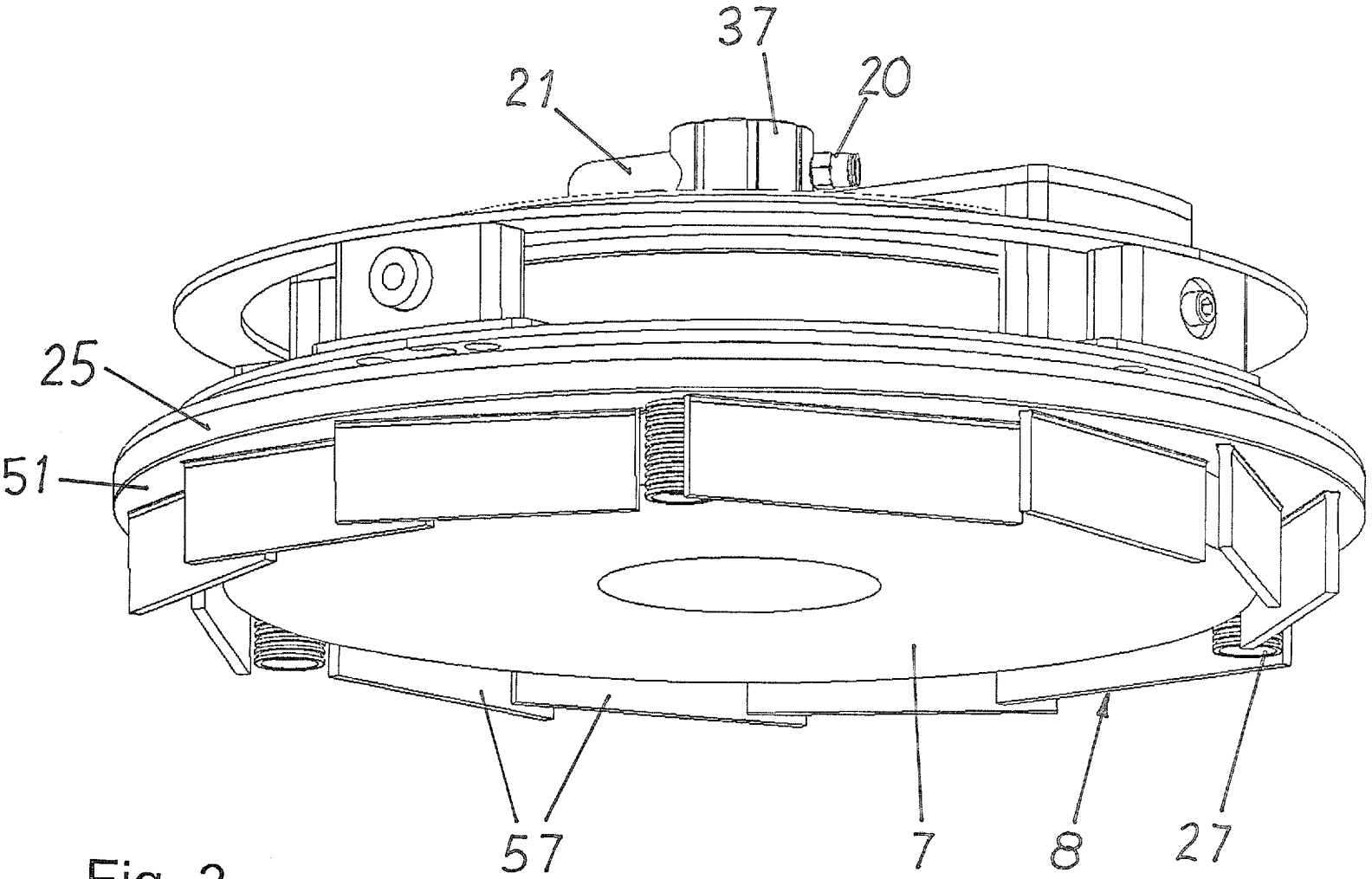
Figure 4:
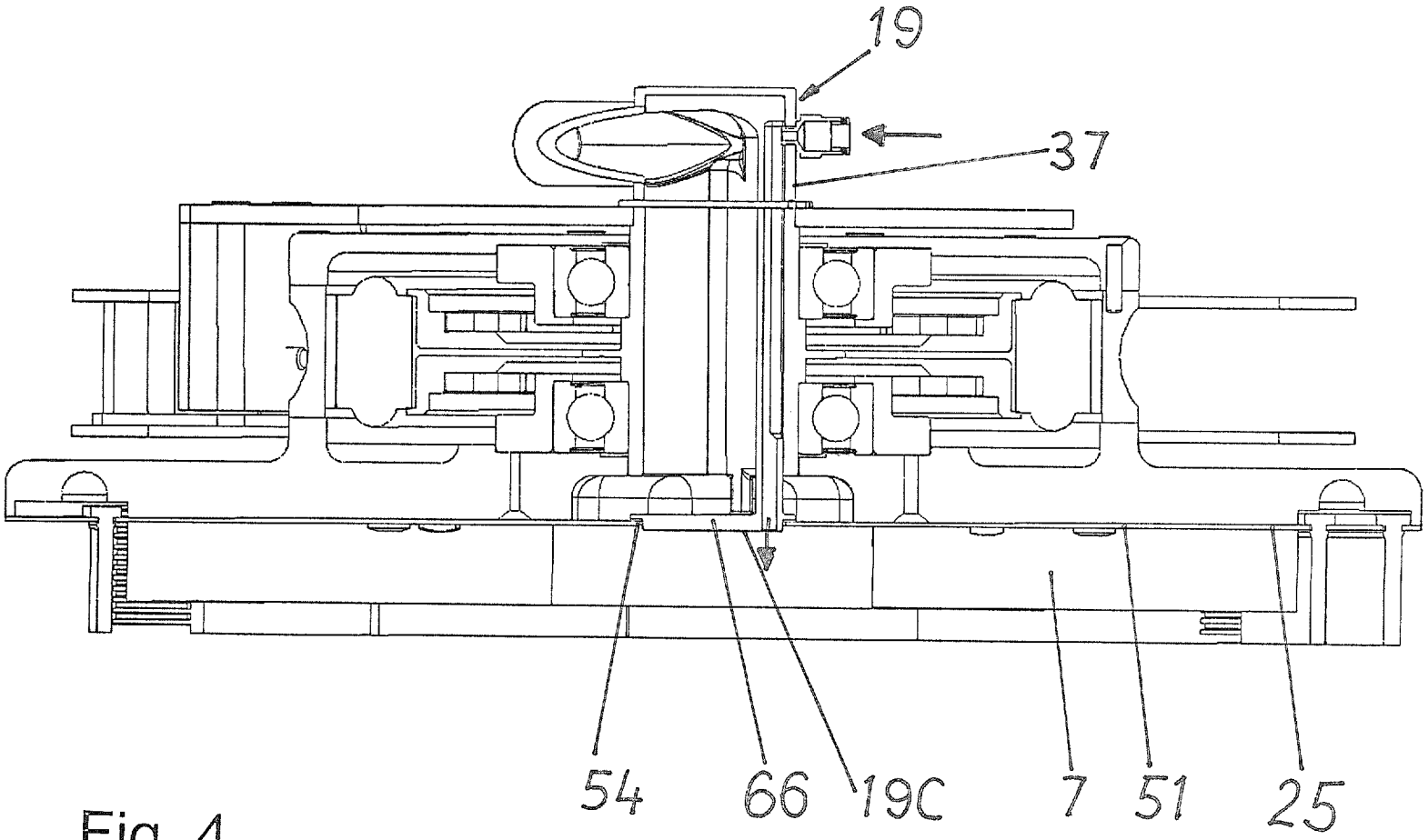
Figure 5:
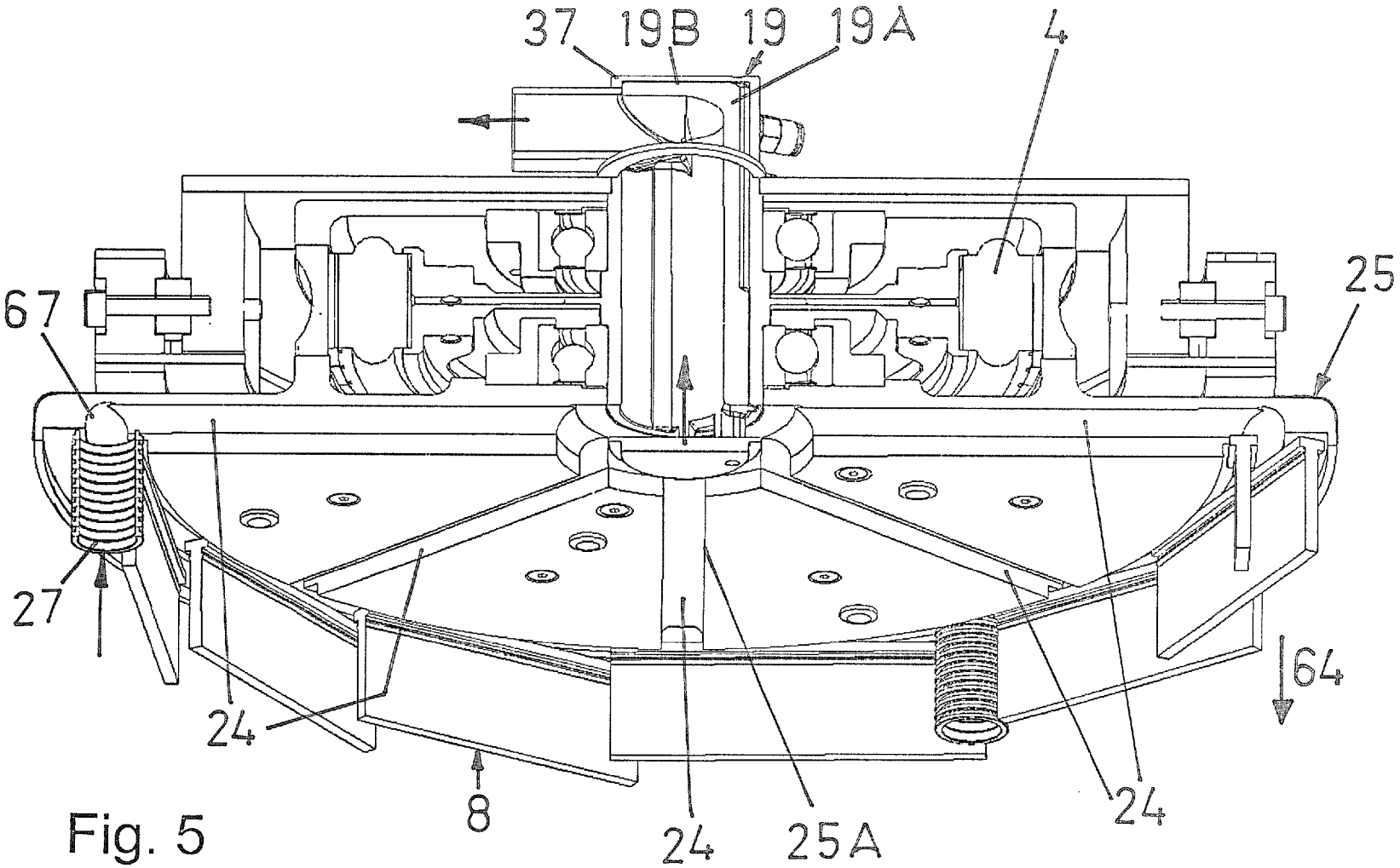
Figure 6:
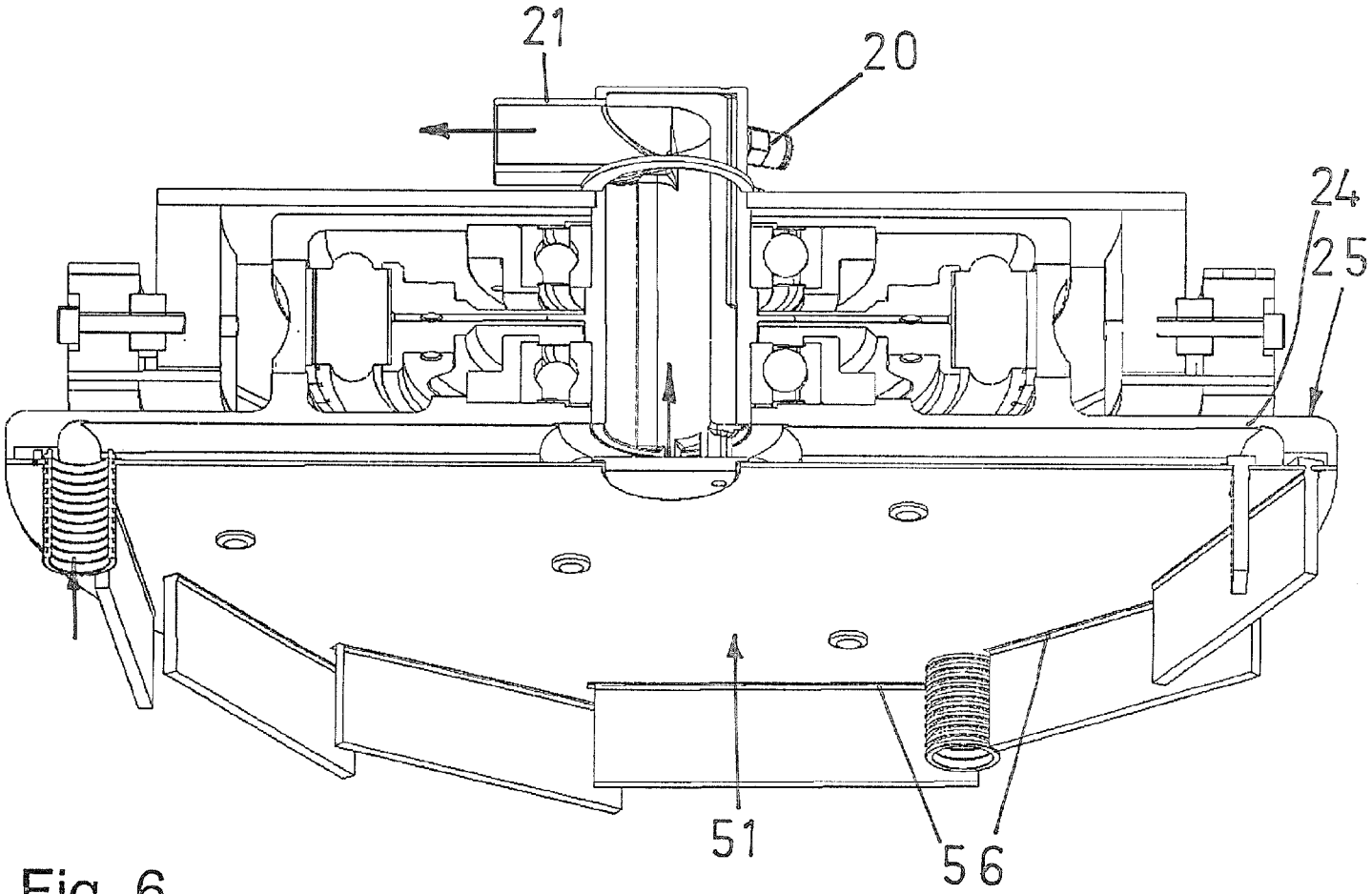
Figure 7:
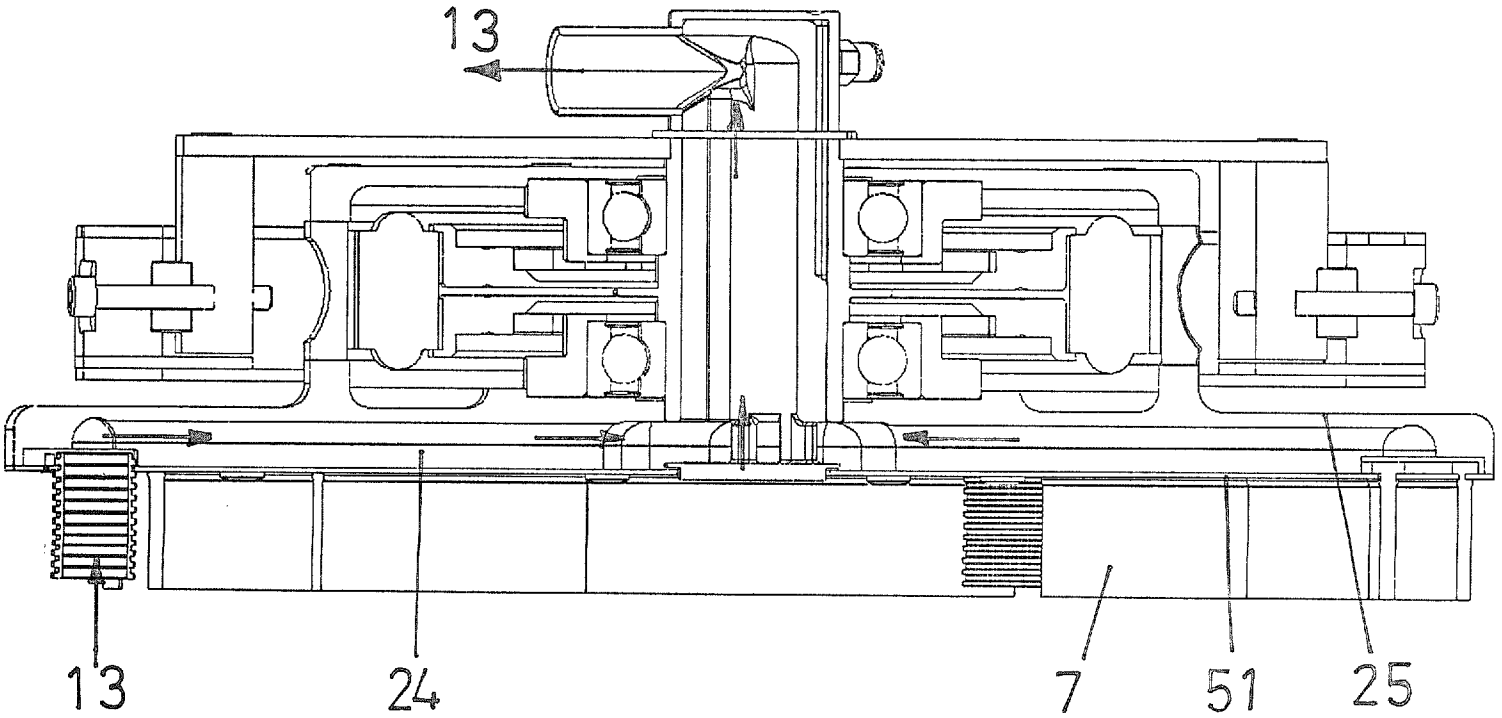
Figure 8:
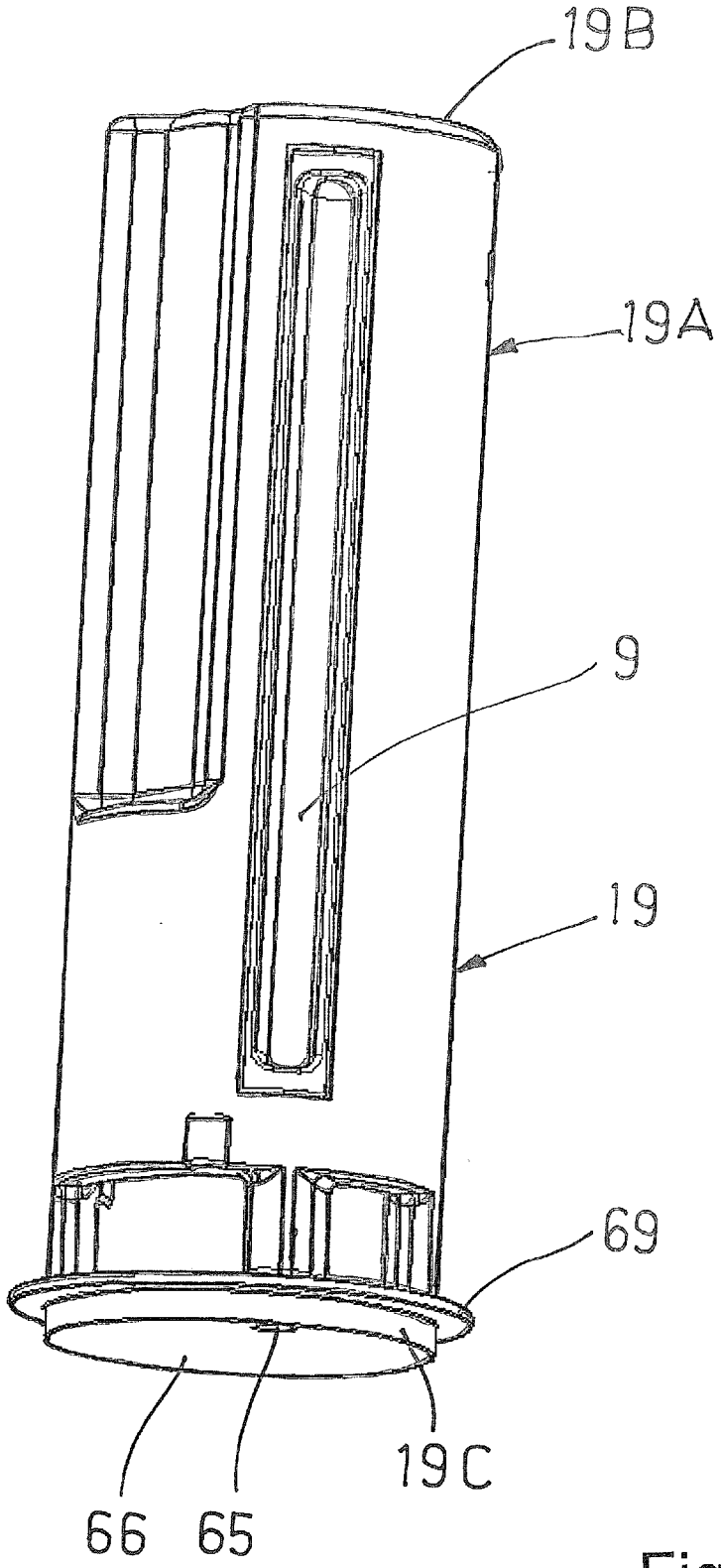
Figure 9:
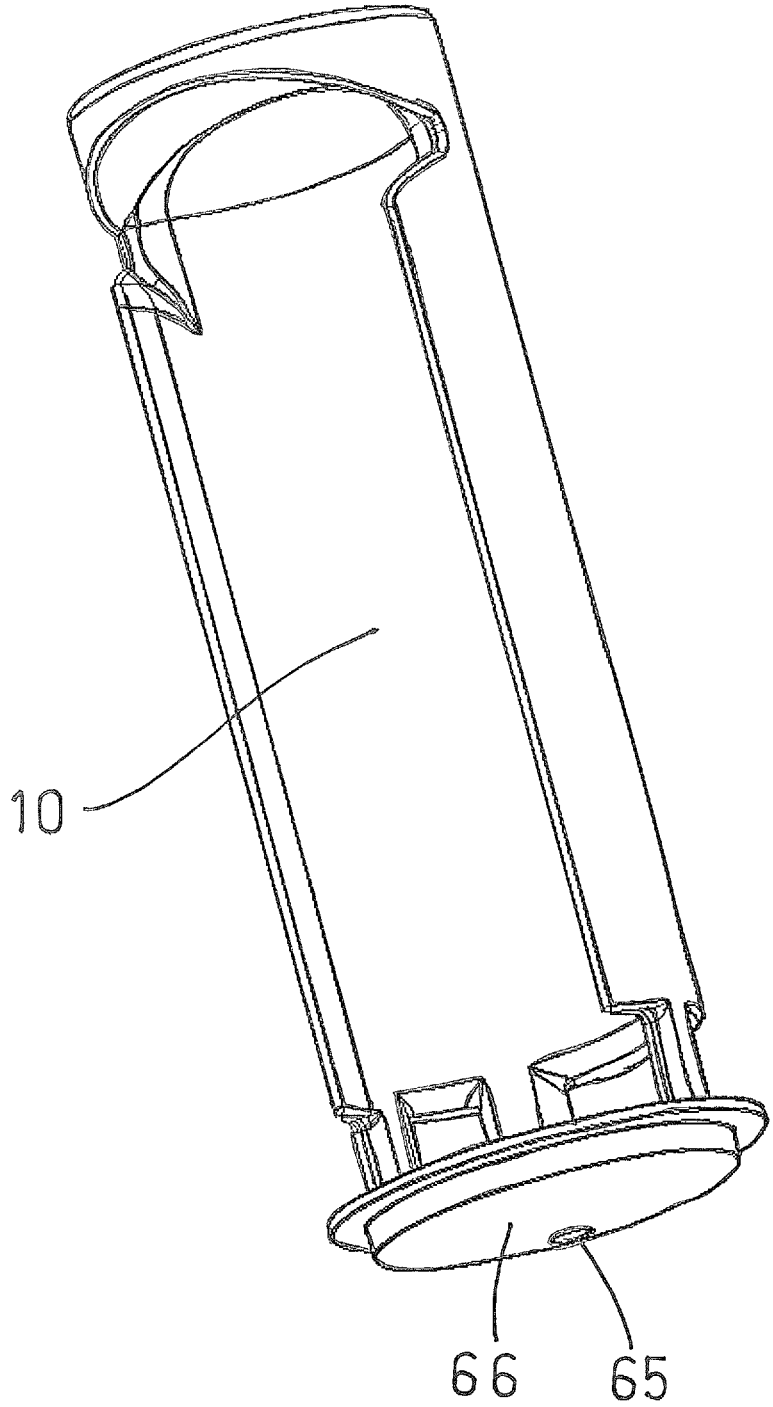
Figure 10:
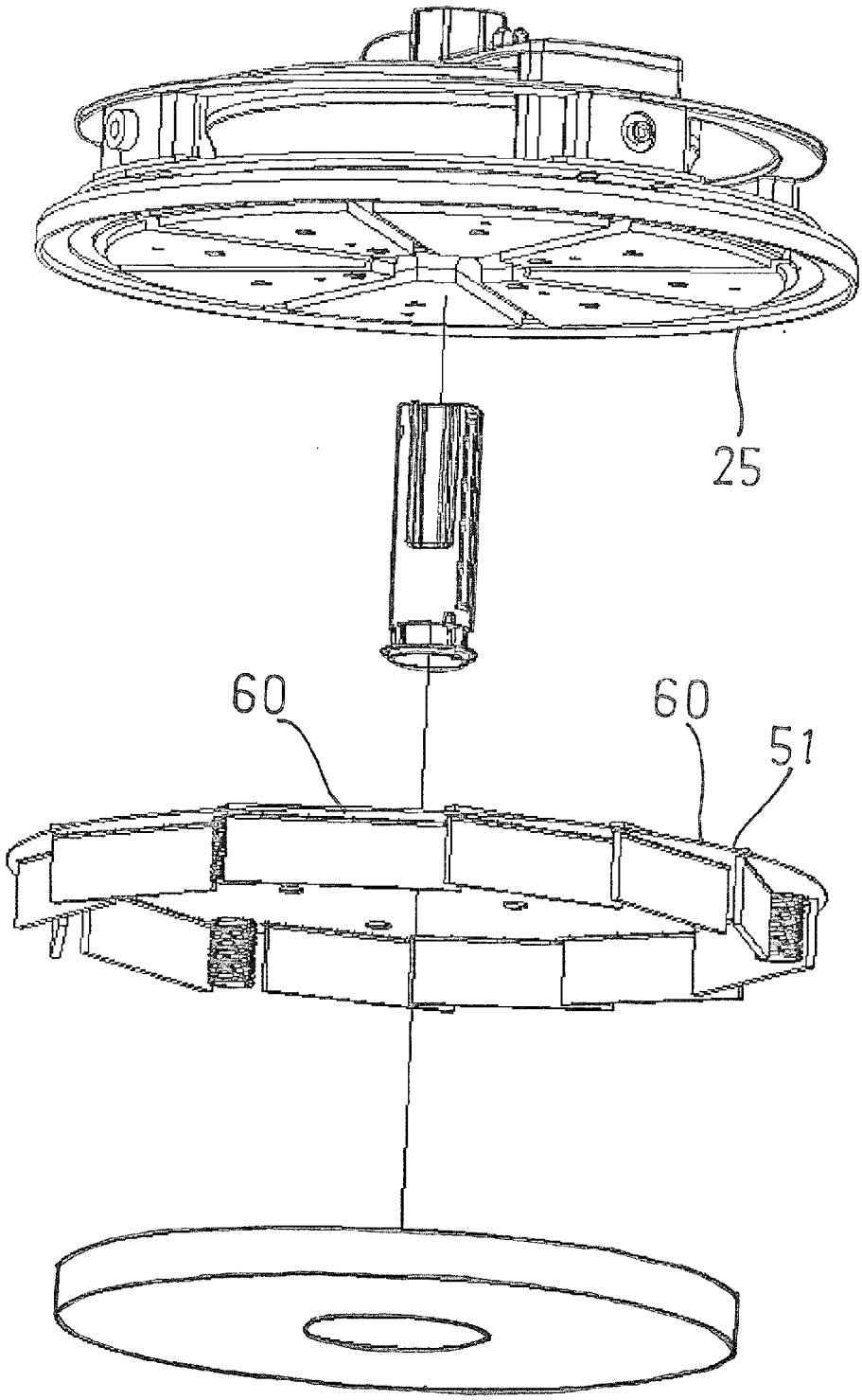
Figure 10A:
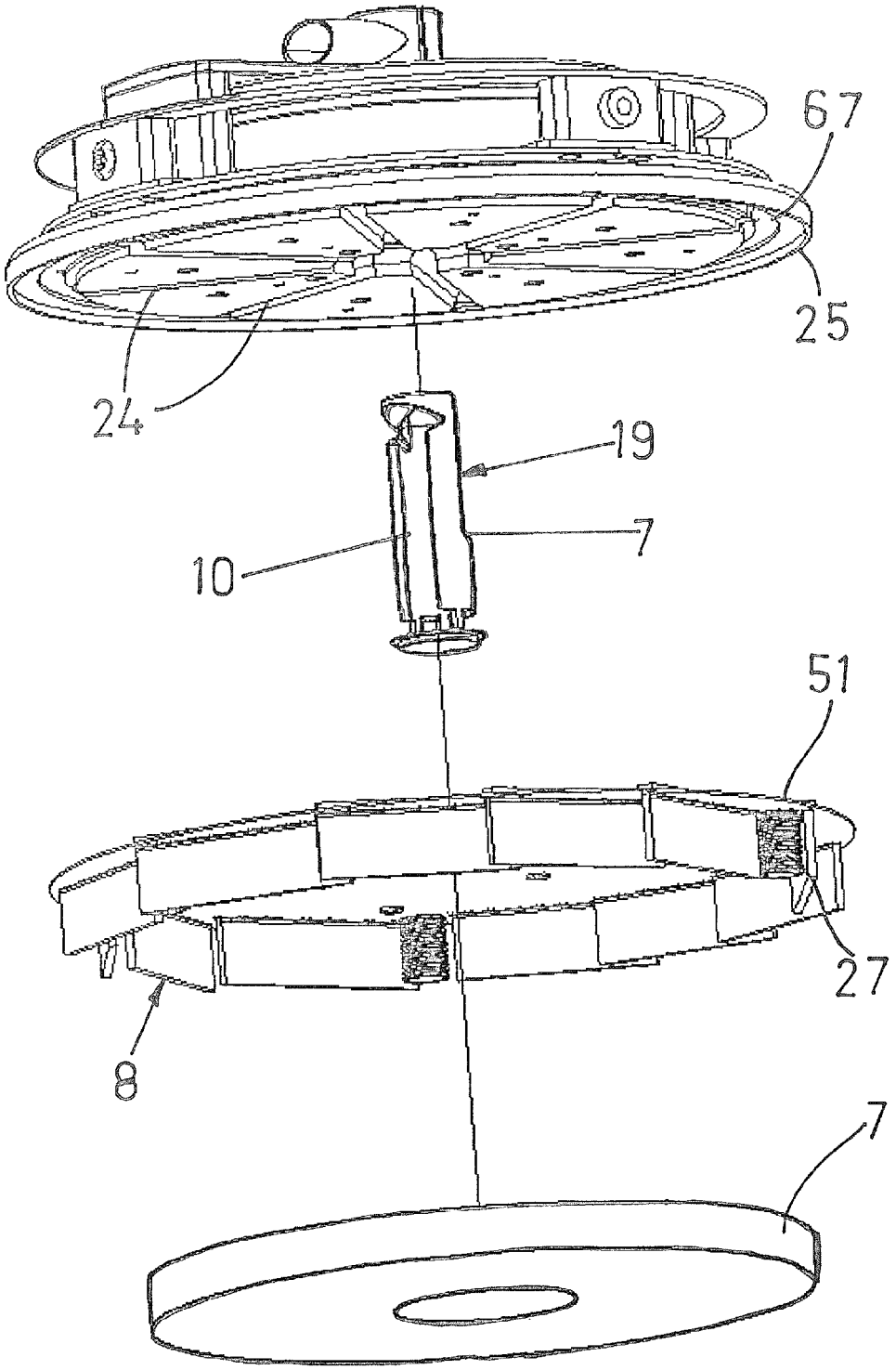
Figure 11:
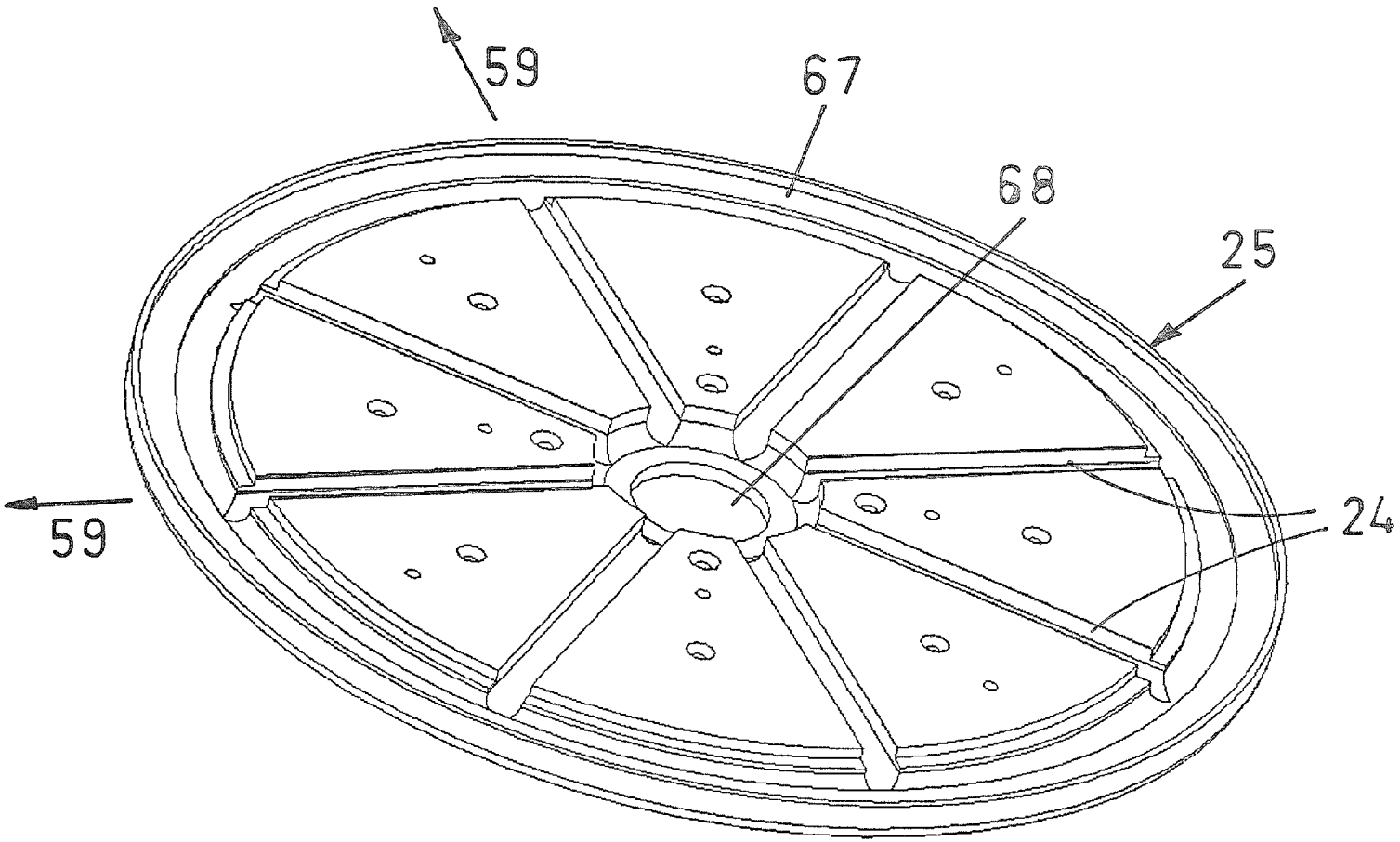
Figure 12:
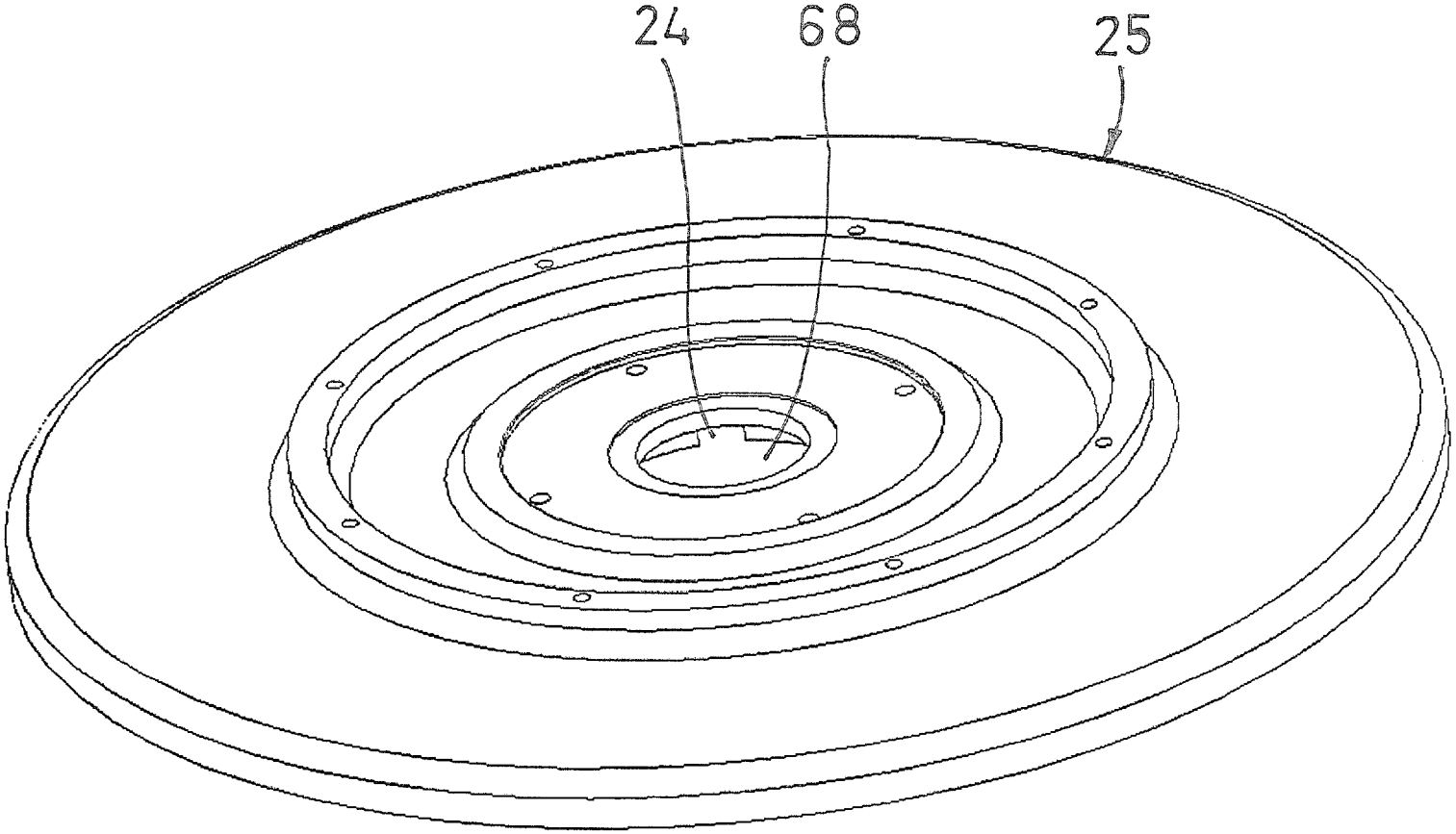

The invention is described below as a preferred embodiment, whereby it is referred to the accompanying drawings, in which FIG. 1 is a perspective cross-sectional view of the cleaning part of a cleaning machine with parts comprised therein, FIG. 2 is a perspective view of the cleaning machine obliquely from above, FIG. 3 is a perspective view of the cleaning machine obliquely from below, FIG. 4 is a cross-sectional view of the cleaning machine, in which the supply of washing liquid is shown, FIG. 5 is a perspective cross-sectional view of the cleaning machine obliquely from below and partly in disassembled state, FIG. 6 is a perspective cross-sectional view of the cleaning machine obliquely from below, in which the sucking-up of dirty washing liquid is shown, FIG. 7 is a cross-sectional view of the cleaning machine, in which the sucking-up of dirty washing liquid is shown, FIGS. 8-9 are perspective views of a central fluid conduit part, FIG. 10 and FIG. 10A illustrate an exploded view of the cleaning machine seen obliquely from below, and FIG. 11 and FIG. 12 illustrate a bottom part seen obliquely from below and obliquely from above, respectively.

A fluid system 50 according to the present invention intended for a cleaning machine 1, which comprises a floor treating brush and/or disc 7 rotatably 58 driven by a motor 4 and exhibiting a surrounding ring-shaped rim 8 and conduit 9 for washing liquid and vacuum suction duct 10 for the supply 11 of clean washing liquid 12 and for suction 13 of dirty washing liquid 14, respectively, comprises a part 25 located at the bottom as well as a centrally located part 19. Said conduit 9 for washing liquid and vacuum suction duct 10 are open seen in the radial direction, but are surrounded by an outer shaft 37 in that the central shaft 19 is formed by an insert, which is releasably received in said outer shaft 37. More precisely, a disc-shaped bottom part 25, which is located above said rotatable brush and/or disc 7, seen when said cleaning machine 1 is held in a horizontal normal cleaning position I, as is illustrated in the drawings, is provided with a number of substantially radially 59 extending vacuum suction ducts 24. Further, a bottom cover 51 is connected to said bottom part 25 and can be released therefrom by pressing in a number of fastening elements 60, which are received in holes in said bottom part 25.

In order to make it possible to suck up dirty washing liquid 14 from the floor 2 or another surface which is cleaned by means of the cleaning machine 1, a number of nozzles 27 are releasably connected by being pressed firmly into openings 61, owing to external surrounding flanges 62 and grooves 63 on the envelope surface of said nozzle 27. Thus, said bottom cover 51 and said bottom part 25, which can be releasably attached to one another, are arranged to be releasable from one another in order to make it easy to reach said substantially radial vacuum suction ducts 24, for example when they are clogged due to the fact that larger objects or other dirt have got stuck in said vacuum suction ducts 24 in the bottom part, on its surface turned downwards. It may also be arranged the other way round, i.e. that said radial vacuum suction ducts are provided in the bottom cover on its surface turned upwards.

Said substantially radial vacuum suction ducts 24 are preferably formed by grooves in said disc-shaped bottom part 25, which grooves are open seen along one of their lateral faces 25A, preferably in the downward direction 64. Said disc-shaped bottom part 25 is provided above said bottom cover 51, seen when a cleaning machine 1 in question is located on a floor or another surface 2.

Along the periphery of said bottom part 25 a surrounding groove 67 is provided, into which the substantially radial vacuum suction grooves 24 debouch from a recess 68, which is located at the centre of the bottom part 25 and which forms a chamber at the lower end portion 19C of a central shaft 19.

Said central shaft 19, which internally exhibits said conduit 9 for washing liquid as well as said axially extending vacuum suction duct 10, connects with said axial vacuum suction duct 10 to said substantially radially extending vacuum suction ducts 24, and said central shaft 19 is with its lower end portion 19C received in a central reception opening 53 in said bottom cover 51, connecting its axial vacuum suction duct 10 with said substantially radially extending vacuum suction ducts 24. The lower portion 19C of said central shaft 19 exhibits a transverse wall 66. A portion of said wall exhibits a shoulder 52, which is received in a central opening 53 in the bottom cover 51 and rests with an edge portion 69 on the upper peripheral edge portion 54 of said opening 53, respectively. In order to let washing liquid 12 through from the conduit 9 for washing liquid in the central shaft 19, this debouches in a bottom opening 65 through the bottom 66 of the central shaft 19. Said central shaft 19 is so arranged, that it can be releasably pulled out from below from an outer shaft 37 consisting of steel or another hard material, which surrounds and receives said central shaft. Said outer shaft 37 surrounds said central shaft 19 along its envelope surface 19A and its upper horizontal end portion 19B. Then, it is easy to clean said central shaft 19 and its conduit 9 for washing liquid and vacuum suction duct 10 when the shaft parts 19, 37 are in disassembled state, and this without any tools being required. Slot-shaped reception openings 56 extend through said bottom cover 51 for the reception of parts 57 of said rim 8. Connections 20, 21 are provided on the machine in order to be able to connect the conduit 9 for washing liquid and the vacuum suction duct 10, respectively, to the intended fluid source, for example a water tank and a unit for the supply of washing liquid 12, and to the intended suction and reception source for the sucking-up of washing liquid 14, respectively. Finally, as far as the design of the cleaning machine 1 is concerned, it is mentioned that the bottom part is arranged to serve as a reception support for a disc-shaped hub motor 4 and to be driven to rotate by said motor.

The arrows in the drawings illustrate central supply of washing liquid 12 and peripheral sucking-up of dirty washing liquid 14 by means of a common central shaft 19 and radially through bottom part 25 and its ducts 24.

The function and nature of the invention are clear from the above description, but, of course, the invention is not limited to the embodiments described above and illustrated in the accompanying drawings. Modifications are possible, especially as far as the nature of the different parts is concerned, or by using equivalent technique, without departing from the scope of the invention as it is defined in the patent claims.

The invention claimed is:

1. A fluid system for a cleaning machine having a floor-treating brush or disk rotatably driven by a motor and a surrounding ring-shaped rim, comprising:

a conduit for supplying washing liquid;

a vacuum suction duct for collecting washing liquid;

a disk-shaped bottom part having substantially radially extending vacuum ducts located above the brush or disk;

a bottom cover releasably connected to the bottom part for reaching the substantially radially extending vacuum ducts; and nozzles connected to the vacuum suction duct along a periphery of the bottom part and bottom cover, wherein the nozzles are configured for collecting washing liquid.

2. The fluid system of claim 1, wherein the substantially radially extending vacuum ducts include grooves in the disk-shaped bottom part that are open along one of their lateral faces.

3. The fluid system of claim 2, wherein the disk-shaped bottom part is located above the bottom cover when the cleaning machine is located on a floor.

4. The fluid system of claim 1, wherein the conduit for supplying washing liquid and the vacuum suction duct are disposed internally in a common central shaft that connects the vacuum suction duct to the substantially radially extending vacuum suction ducts.

5. The fluid system of claim 4, wherein the central shaft has a lower end portion that is received in a central reception opening in the bottom cover, thereby connecting the vacuum suction duct to the substantially radially extending vacuum suction ducts.

6. The fluid system of claim 5, wherein the lower end portion has a transverse wall, and a portion of the transverse wall has a shoulder that is received in the central opening in the bottom cover and that rests on an upper peripheral edge of the central opening.

7. The fluid system of claim 6, wherein an opening for letting washing liquid through from the conduit in the central shaft debouches in a bottom opening in a bottom of the central shaft.

8. The fluid system of claim 4, wherein a protecting shaft surrounds at least a portion of the central shaft.

9. The fluid system of claim 1, wherein slot-shaped openings extend through the bottom cover for the receiving parts of the ring-shaped rim.

10. The fluid system of claim 1, wherein the bottom part is configured to support a disk-shaped hub motor and to be rotationally driven by the hub motor.

* * * * *